US009586791B2

(12) United States Patent
Minatta et al.

(10) Patent No.: US 9,586,791 B2
(45) Date of Patent: Mar. 7, 2017

(54) ACTUATING ELEMENT FOR ELEVATOR SAFETY APPARATUS

(71) Applicant: Inventio AG, Hergiswil (CH)

(72) Inventors: Massimo Minatta, Luzern (CH); Alfonso Garcia, Zaragoza (ES)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 14/428,114

(22) PCT Filed: Aug. 29, 2013

(86) PCT No.: PCT/EP2013/067878

§ 371 (c)(1),
(2) Date: Mar. 13, 2015

(87) PCT Pub. No.: WO2014/040861

PCT Pub. Date: Mar. 20, 2014

(65) Prior Publication Data

US 2015/0225207 A1 Aug. 13, 2015

(30) Foreign Application Priority Data

Sep. 14, 2012 (EP) ..... 12184485

(51) Int. Cl.
*B66B 5/00* (2006.01)
*B66B 5/22* (2006.01)
*B66B 19/00* (2006.01)

(52) U.S. Cl.
CPC ..... *B66B 5/005* (2013.01); *B66B 5/22* (2013.01); *B66B 19/00* (2013.01)

(58) Field of Classification Search
CPC ..... B66B 20/00; B66B 19/00; B66B 19/02; B66B 5/04; B66B 5/042; B66B 5/005; B66B 5/22
See application file for complete search history.

(56) References Cited

U.S. PATENT DOCUMENTS 604,360 A * 5/1898 Bell ..... B66B 5/08 187/306
1,382,211 A * 6/1921 Miller ..... B66B 5/18 187/359
4,650,036 A * 3/1987 Matsuda ..... B66B 9/00 182/142
5,033,586 A * 7/1991 Richards ..... B66B 9/187 187/259

(Continued)

FOREIGN PATENT DOCUMENTS

EP 1422182 A1 5/2004
JP 8295468 A 11/1996

(Continued)

*Primary Examiner* — Michael Mansen
*Assistant Examiner* — Stefan Kruer
(74) *Attorney, Agent, or Firm* — Fraser Clemens Martin & Miller LLC; William J. Clemens

(57) ABSTRACT

A device for activating and deactivating a safety apparatus of an elevator car during assembly of an elevator installation includes an actuating element for attachment to the elevator car cage, wherein the actuating element in a first position P1 activates the safety apparatus and can be brought by an engineer into a second position P2 in which it does not exert any action on the safety apparatus.

12 Claims, 7 Drawing Sheets

(56) References Cited

U.S. PATENT DOCUMENTS

| | | | | |
|---|---|---|---|---|
| 6,220,112 | B1 * | 4/2001 | Graham | B60K 26/02 477/125 |
| 6,357,556 | B1 * | 3/2002 | Pettersson | B66B 5/04 187/414 |
| 6,362,441 | B1 * | 3/2002 | Xie | G05G 1/30 200/81 H |
| 2006/0266589 | A1 * | 11/2006 | Anttila | B66B 5/005 187/351 |
| 2007/0000734 | A1 * | 1/2007 | Hanninen | B66B 5/02 187/373 |
| 2009/0272222 | A1 * | 11/2009 | Long | G05G 1/305 74/560 |
| 2010/0133048 | A1 * | 6/2010 | Barneman | B66B 19/00 187/414 |

FOREIGN PATENT DOCUMENTS

| | | | | |
|---|---|---|---|---|
| JP | 2005112580 | A | 4/2005 | |
| JP | 2009067493 | A | 4/2009 | |
| WO | 9840305 | A1 | 9/1998 | |
| WO | 0144096 | A1 | 6/2001 | |
| WO | WO 2008039199 | A1 * | 4/2008 | B66B 19/02 |

* cited by examiner

ACTUATING ELEMENT FOR ELEVATOR SAFETY APPARATUS

FIELD

The invention relates to a device for activating and deactivating a safety apparatus of an elevator car during assembly of an elevator installation.

BACKGROUND

During assembly of an elevator installation there is these days increasing use of the roof of the elevator car by engineers as a work platform. This is particularly so in the case of assembly of elevators without scaffolding. In that regard, the car during assembly of the installation is suspended at a chain hoist or comparable lifting device which is in turn attached to the shaft head. With the help of the chain hoist the car is moved by the elevator engineer in the shaft to the position desired by the engineer and the elevator engineer can subsequently carry out his or her work from the car roof during the installation.

If one or more elevator engineers are now present on the car it has to be ensured that the car does not move in undesired manner in the shaft. In particular, it has to be ensured that in the case of failure of the chain hoist the car does not crash down in the shaft. At the same time, however, it has to be possible for the engineer to move the car without problem to the place, which is desired by the engineer, for carrying out the necessary work.

In order to realize this it is, for example, proposed in EP 1 254 070 to mount movable hooks on the elevator car, which hooks can be brought by way of a cable by an engineer into a position in which they hook into brackets, which are used for fixing the guide rails, or detent there. The hooks are brought by the engineer into the detent position when the engineer works on the car roof. They can be released with the help of the cable so that they do not engage in the corresponding fastenings for the guide rails. The engineer can subsequently move the car. The disadvantage in that regard is that the fastening elements for the guide rails are, in certain circumstances, mounted relatively far apart in the shaft. Thus, the engineer can assume only certain positions in the shaft with the car, namely those in which the hooks are in the vicinity of the fastening elements. In other positions the car would, in the case of failure of the chain hoist, drop a relatively large distance before the hooks engage in the fastening elements, which could lead to risk to the engineer.

SUMMARY

An object of the present invention is therefore to indicate a device which makes possible any car position during assembly and which prevents downward movement in the event of failure of the chain hoist.

The object is fulfilled by a device for activating and deactivating a safety apparatus of an elevator car during assembly of an elevator installation, wherein the device comprises an actuating element provided for the purpose of being attached to a car, wherein the actuating element in a first position so acts on the safety apparatus that the safety apparatus is activated and wherein the actuating element in the case of need can be brought by an engineer into a second position in which it does not exert any action on the safety apparatus.

The invention is based on recognition that the safety apparatus, which is mounted on the elevator car anyway, can be used for securing the car during the assembly. However, in order that the car in the event of failure of the support means does not first have to be accelerated, the safety apparatus must be activated. This means that the friction linings or wedges of the safety apparatus must be in a position to immediately wedge in the case of the smallest downward movement of the car and securely hold the car at the guide rails without any acceleration of the car occurring. If, however, the friction linings or wedges are in such a position, then the car cannot move, since the safety apparatus would then immediately engage at least in the case of downward movement of the car. The engineer can therefore deactivate the safety apparatus by means of the invention when, during assembly, the engineer would like to move the car in the shaft. The engineer can activate the safety apparatus again when the car is stationary for a longer period of time at a specific position and the engineer would like to carry out work on the roof.

For operating (activating and deactivating) the safety apparatus a simple actuating element is proposed which is actuated by the engineer exactly when he or she wants to move the car. Through actuation of the actuating element the safety apparatus is brought into the deactivated state. By this there is understood a state in which the friction linings or wedges of the safety apparatus do not directly wedge, in the case of downward movement of the car, and bring the car to standstill, but in which the safety apparatus is triggered quite normally by the speed limiter in the event of excess speed of the car. When the engineer ends actuation of the actuating element again then it returns to its original position and the safety apparatus is activated once more so that it would immediately engage in the event of failure of the chain hoist. The device with the actuating element has the advantage that the engineer can bring, directly by his or her own action, the safety apparatus from the deactivated to the activated position so that the highest level of safety for the engineer is ensured. However, the engineer can also bring the safety apparatus into the deactivated position by actuation of the actuating element so that the engineer can move the car. All this can ideally happen from the roof of the elevator car so that the engineer does not have to leave his or her work platform.

A further advantage is that safety elements present in any case, such as the safety apparatus, are used for safety during assembly. It is not necessary to mount any additional, costly safety elements on the car. The engineer merely has to mount the device with the actuating element on the car roof so that it can exert its action on the safety apparatus and the engineer is himself or herself in a position of operating the actuating element for movement of the car. Moreover, it is advantageous that the actuating element can be operated by the engineer exactly when he or she would like to move the car. While the car is thus stationary and the car roof is used as an assembly platform the actuating element of the device does not need to be actuated by the engineer and therefore also does not demand any additional attention.

A further advantageous construction consists in that the actuating element in the first position acts in such a way on a speed limiter cable that the safety apparatus connected with the speed limiter cable is activated. In that regard, the speed limiter cable, which acts in any case on the safety apparatus, is used as a transmission element between the actuating element and the safety apparatus. Use is thus made of components of the elevator, which have to be installed in any case, for the device for activating and deactivating the safety apparatus.

As an alternative to use of the speed limiter cable it is also conceivable to employ a hook or a long rod which is fixed to the actuating element and which for its part, in the case of actuation of the actuating element by the engineer, frees the safety apparatus so that the safety apparatus is deactivated. In both cases the actuating element is operatively connected with the respective element (speed limiter cable or hook) for transmission of the movement.

A further advantageous construction consists in the actuating element having a cut-out within which the speed limiter cable can be guided. The actuating element thus comprises the speed limiter cable and this enables good transmission of the movement of the actuating element to the speed limiter cable.

A further advantageous construction consists in that the actuating element has clamping jaws which fix the speed limiter cable when the actuating element moves towards the first position and which release the speed limiter cable when the actuating elements moves towards the second position. If the actuating element is brought by the engineer into the second position, then the clamping jaws loosen and the speed limiter cable is released. The actuating element or the device thus no longer exerts force on the speed limiter cable, whereby the action of the actuating element on the safety apparatus is cancelled. Thus, the safety apparatus can be transferred to the deactivated state and the car moved.

As an alternative to the clamping jaws arranged at the actuating element the device can also comprise an abutment element which is so fixable to the speed limiter cable that the actuating element in the first position exerts a vertically upwardly directed force on the abutment element. If the actuating element is in the first position, then it presses from below against the abutment element. The abutment element itself is again fixed to the speed limiter cable so that by way of the abutment element, which is urged upwardly, the speed limiter cable is also drawn upwardly. As a consequence, the actuating element in the first position acts in such a way on the safety apparatus that it is activated. If the actuating element is now actuated by the engineer, then the force exerted from below on the abutment element diminishes or force is no longer exerted at all and in this case as well the speed limiter cable is released so that the safety apparatus can again go over to the deactivated state. The advantage in this regard is that the abutment element can be mounted by the engineer at a finely adjustable position of the speed limiter cable so that the activation of the safety apparatus can be set in optimum manner.

A further advantageous construction of the invention consists in that the actuating element comprises counter-bearings for positioning of the abutment element. If the abutment element is fixed to the speed limiter cable then it could happen that the actuating element, which acts from below against the abutment element, is in an unfavorable position, so that the abutment element slips past the actuating element and the actuating element thus could not realize its action. In order to ensure that the abutment element is always mounted in the correct position in relation to the actuating element, counter-bearings are therefore directly mounted on the actuating element.

An advantageous development consists in that the actuating element is constructed as a pedal which can be brought by an engineer into the second position against a restoring force. The engineer therefore merely has to operate the corresponding pedal by foot or hand and the safety apparatus is already freed by this simple operation. As an alternative to construction as a pedal it is also conceivable for the actuating element to be constructed as a form of lever which has to be operated by the engineer.

Advantageously, the restoring force against which the engineer has to move the pedal or lever is generated by means of a spring or a spring element. The force exerted by the actuating element on the speed limiter cable or the rod or the hook is thus produced by this spring element. The engineer moves the actuating element against this force so that it is also ensured in every case that the actuating element cannot transfer by itself from the first position in which the safety apparatus is activated to the second position in which the safety apparatus is deactivated. The spring element can in that regard be constructed as, for example, a helical spring acting against the actuating element. However, the spring element can also be realized in the construction of the actuating element itself, in that a spring steel or an appropriate material having the desired resilient or force-applying property is used.

In a development, a spring is arranged between the abutment element and the actuating element. This spring serves for adjusting the vertically upwardly directed force. This has the advantage that even in the case of mounting of the abutment element in a somewhat unfavorable position the force exerted by the actuating element on the speed limiter cable is defined so that activation of the safety apparatus also takes place to a defined extent.

An advantageous development consists of the device comprising a housing which receives the actuating device in such a manner that the actuable area of the actuating device is limited. This has the advantage that the engineer cannot operate the actuating device in error and thus could deactivate the safety apparatus. The engineer has to actively operate the actuating device at the place where it is intended. The limitation of the operable area of the actuating device also ensures that the device providing safety cannot be manipulated in such a way that, for example, the actuating element is brought into the second position through application of a heavy load and thus the safety apparatus permanently deactivated.

A further advantageous construction consists in that the device comprises a safety switch, wherein the safety switch prevents movement of the car or the lifting device when the safety apparatus is activated. Movement of the car when the safety apparatus is activated would have the consequence, at least in the event of downward travel, that the safety apparatus would engage without delay, since it is indeed in the activated state. This is to be prevented, so that the safety apparatus in such a case would not have to be first released again. The safety switch at the device ensures, in the case of the safety apparatus activated by way of the elevator control, that movement of the car is impossible. Only when the actuating element of the device is actuated by the engineer is the safety circuit closed by the safety switch and the car can move in the elevator shaft.

The device is used for preventing unintended movement of an elevator car during assembly of an elevator installation. In that regard, the device is mounted by an engineer on an elevator car in such a way that the actuating element is in the first position and can be brought by the engineer into the second position before the car is moved. This has the advantage that the device has to be used merely for installation of the lift elevator assembly. The device can subsequently be removed again by the engineer and the engineer can use the same device for assembly of a further elevator installation.

DESCRIPTION OF THE DRAWINGS

The invention is described and explained in more detail in the following by way of the figures, in which.

DETAILED DESCRIPTION

Figure 1B:
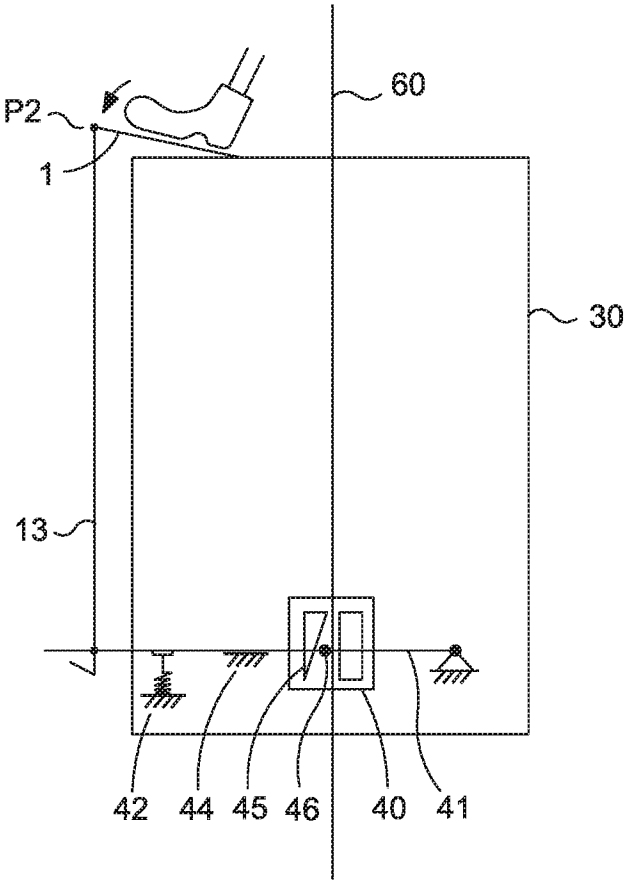
FIGS. 1*a* and 1*b* show a schematic illustration of a device for activating a safety apparatus.
Figure 1A:
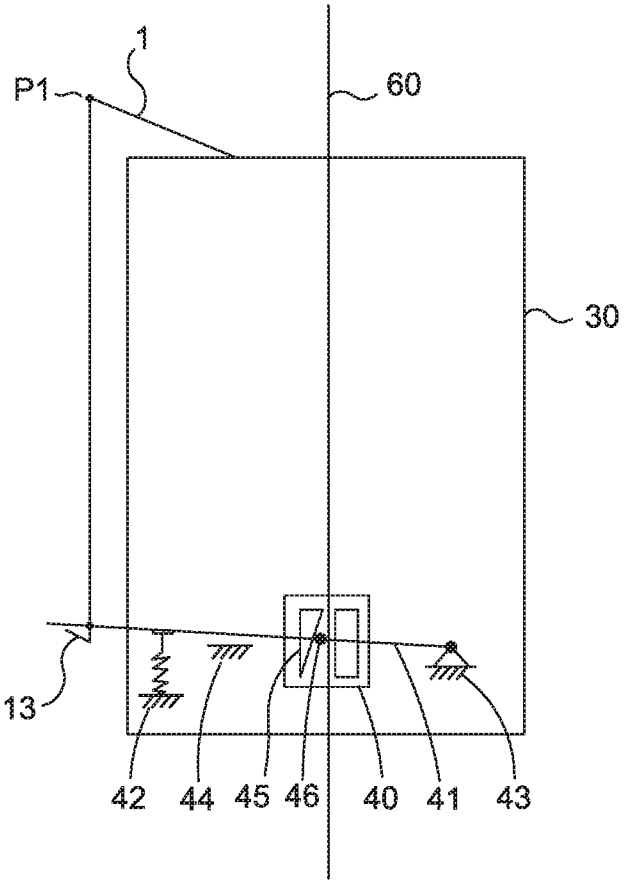

FIGS. 1*a* and 1*b* show a schematic illustration of the device for activating and deactivating a safety apparatus 40 of an elevator car 30. The safety apparatus 40 is illustrated in the activated state in FIG. 1*a*, whereas the safety apparatus 40 is illustrated in the deactivated state in FIG. 1*b*. The car 30 is moved in the elevator shaft (not illustrated) along the guide rails 60. In that case, the safety apparatus 40 acts, in the case of a sudden downward movement of the car 30, in such a manner on the guide rail 60 that the car 30 is brought to standstill with as little delay as possible. For this purpose, arranged in the safety apparatus 40 are brake elements 45, 46 (friction elements or wedges) which in the activated state in Figure la interact in such a way that the safety apparatus 40 wedges with the guide rail 60 when the car 30 executes a downward movement. In FIG. 1*b* the brake elements 45 and 46 of the safety apparatus are so arranged that the car 30 is not fixed to the guide rail 60 by the safety apparatus 40.

In FIG. 1*a* the safety brake 40 is shifted into an activated state in that the lever 41 is raised about the fulcrum 43 and thus the brake element 46 wedges between the brake element 45 and the guide rail 60. This produces securing of the car 30 to the guide rail 60 by the safety apparatus 40 when the car executes a downward movement. The raising of the lever 41 takes place in FIG. 1*a* with the help of the actuating element 1, which is disposed in the position P1. In the position P1 the lever 41 is raised by means of the hook 13 of the lever 41 against the force which acts via a spring element 42 on the lever 41. The brake element 46 is thereby displaced towards the brake element 45 and the safety apparatus 40 is in the activated position. The actuating element 1 is mounted by the engineer on the roof of the car 30 in such a way that it is arranged in position P1 and the safety apparatus 40 is activated by way of the hook 13 and the lever 41.

In FIG. 1*b*, the safety apparatus 40 is shifted into the deactivated state by an action of the engineer, for example by treading down the actuating element 1. The engineer can also actuate the actuating element 1 by, for example, hand if the element is a form of lever. Through the actuation, the actuating element 1 is brought from the position P1 in FIG. 1*a* to the position P2 in FIG. 1*b*. The hook 13 is thereby moved in such a way that it frees the lever 41 of the safety apparatus 40. The lever 41 is now drawn downwardly by the spring element 42 so that it bears against the abutment element 44. The brake elements 45 and 46 of the safety apparatus 40 are thereby brought into a position which corresponds with the deactivated state of the safety apparatus 40.

When the engineer concludes actuation of the actuating element then it returns to the position P1 and, by way of the hook 13, the lever 41 of the safety apparatus is raised again so that the safety apparatus 40 is activated once more.

Figure 2B:
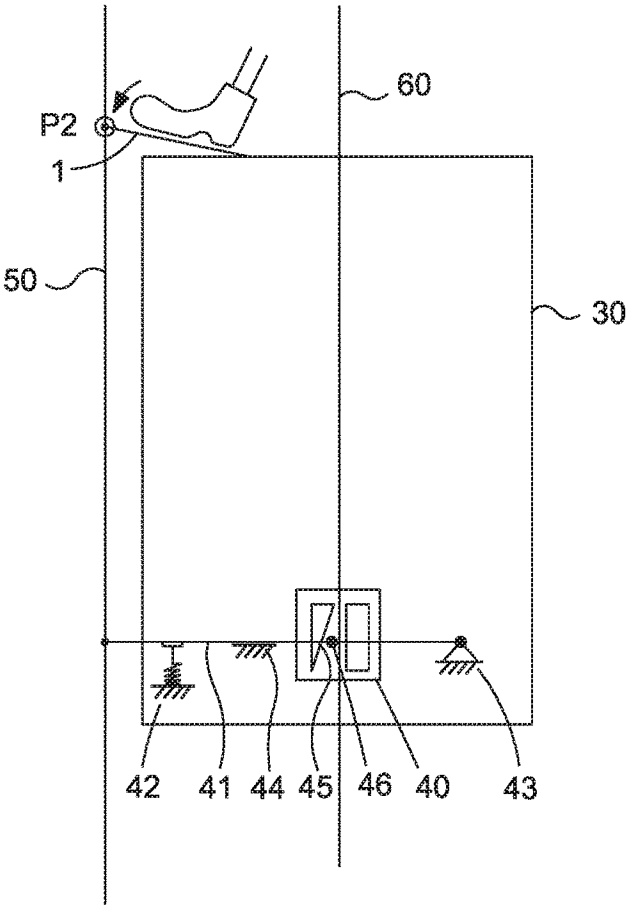
FIGS. 2*a* and 2*b* show a further form of embodiment of a device for activating a safety apparatus.
Figure 2A:
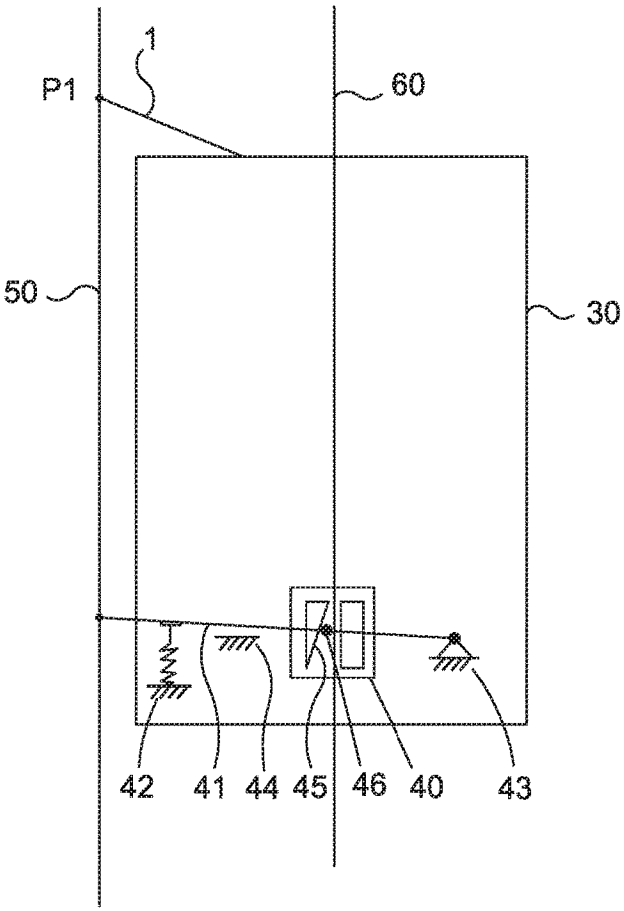

FIGS. 2*a* and 2*b* similarly show a device for activating and deactivating the safety apparatus 40 of an elevator car 30. In this embodiment of the device the actuating element 1 does not act on the lever 41 of the safety apparatus 40 by way of a hook 13, but instead the action is achieved by way of the cable 50 of the speed limiter. For this purpose the actuating element 1 in FIG. 2*a* position P1 is operatively connected with the speed limiter cable 50. The actuating element 1 acts against the force of the spring element 42, which draws the lever 41 of the safety apparatus downwardly in such a way that the lever is drawn upwardly against this spring force by way of the speed limiter cable 50. For that purpose, the actuating element 1 exerts a force on the operatively connected speed limiter cable 50 upwardly in vertical direction, which corresponds with at least the force of the spring element 42. The functionality of the safety apparatus 40 is as described in FIG. 1*a* and the safety apparatus 40 is activated in FIG. 2*a* by the actuating element 1.

In FIG. 2*b* the safety apparatus 40 is deactivated through actuation of the actuating element 1 by the engineer. The actuating element 1 is brought by the engineer into the position P2 and the action of the actuating element 1 on the speed limiter cable 50 connected with the lever 41 of the safety apparatus 40 is cancelled. The lever 41 of the safety apparatus 40 can thereby be moved against the abutment 44 by means of the force of the spring element 42, the brake elements 45, 46 of the safety apparatus 40 are thus displaced relative to one another and the safety apparatus 40 is deactivated. In this embodiment it is equally possible for the actuating element to be brought into the position P2 either by treading on a pedal or by pulling or moving a lever. When the engineer releases her or her hand or foot from the actuating element 1 it automatically returns to the position P1 and thus acts again on the speed limiter cable 50, which once more activates the safety apparatus 40 by way of the lever 41.

Figure 3:
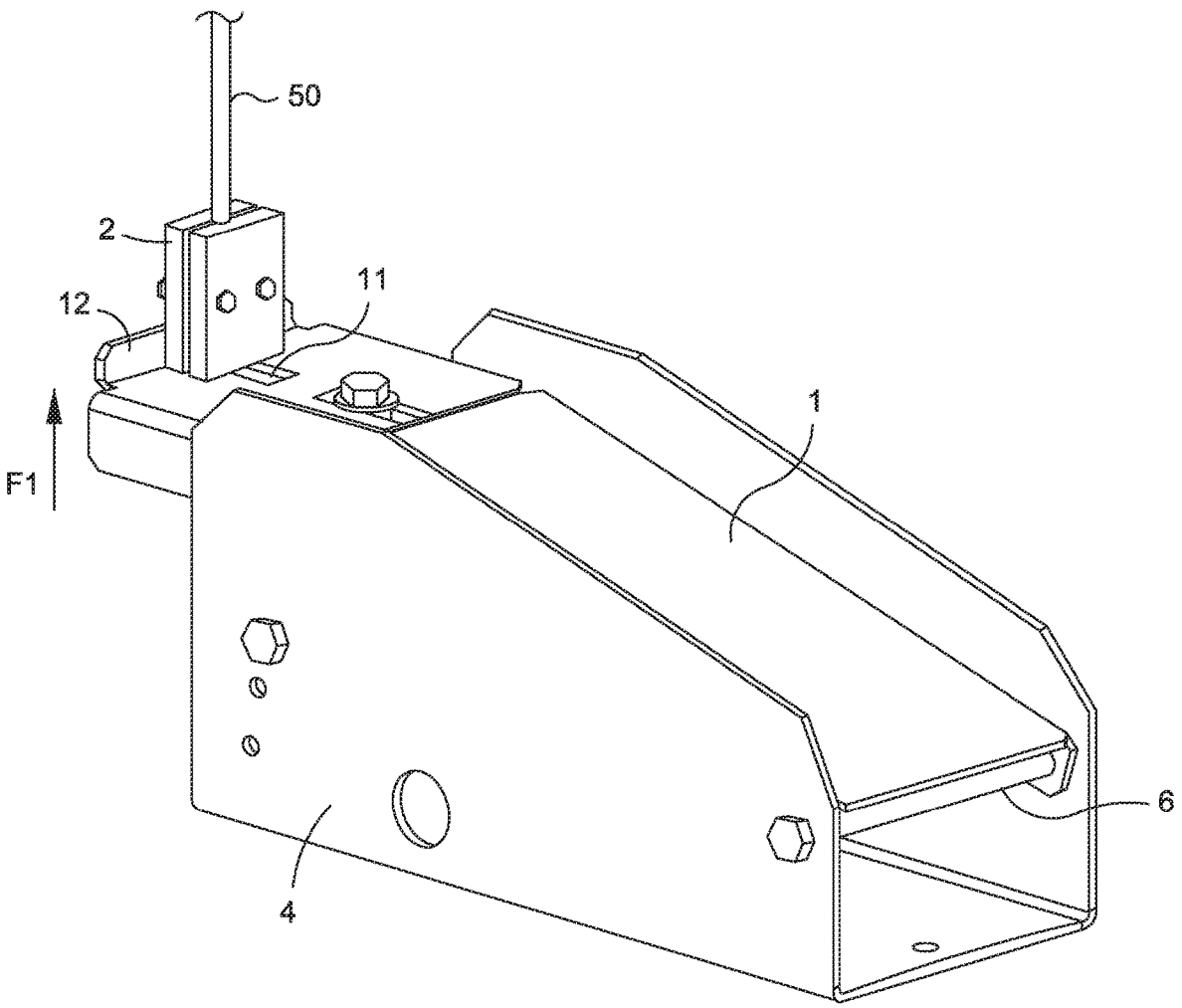
FIG. 3 shows a perspective illustration of a form of embodiment of the device for activating a safety apparatus.

FIG. 3 shows a perspective illustration of a form of embodiment of the device for activating and deactivating the safety apparatus 40 of an elevator car 30. In this case the actuating element 1 is constructed as a pedal. The pedal has a cut-out 11, in which the speed limiter cable 50 can be received or which surrounds the speed limiter cable 50. The actuating element 1 is mounted in a housing 4 of the device by means of, for example, a bolt 6. The actuating element 1 acts by a force F1, which is directed vertically upwardly in the direction of the speed limiter cable 50, against an abutment element 2. The abutment element 2 is attached by the engineer to the speed limiter cable 50. The abutment element 2 consists, in the illustrated embodiment, of two plate-like bodies which are so fixed by means of screws to the speed limiter cable 50 that the cable extends therebetween. The abutment element 2 can in that case be constructed in any desired mode and manner; it merely has to be ensured that it can be securely fastened to the speed limiter cable 50 and that the actuating element 1 can act from below against the abutment element 2 by the force F1.

For better positioning of the abutment element 2, counter-bearings 12 are arranged at the actuating element in the embodiment. These counter-bearings 12 act against the abutment element 2, so that it cannot slip off the actuating element 1. The counter-bearings 12 can be simple metal ridges as illustrated in the embodiment. However, the counter-bearings can also be realized in a different way. The actuating element 1 is so arranged in the housing 4 that projections or edges of the housing 4 protrude beyond the actuating element 1 so that the activation area of the actuating element 1 is bounded. It is thereby ensured that an engineer cannot, through application of a block or a larger, heavy plate, permanently bring the actuating element 1 into the position P2 in which the safety apparatus 40 would be deactivated. The speed limiter cable 50 is raised against the force, which is not illustrated in FIG. 3, of the spring element 42 of the safety apparatus 40, and thus activates the safety apparatus 40, by the force F1 by which the actuating element 1 acts from below on the abutment element 2.

Figure 4:
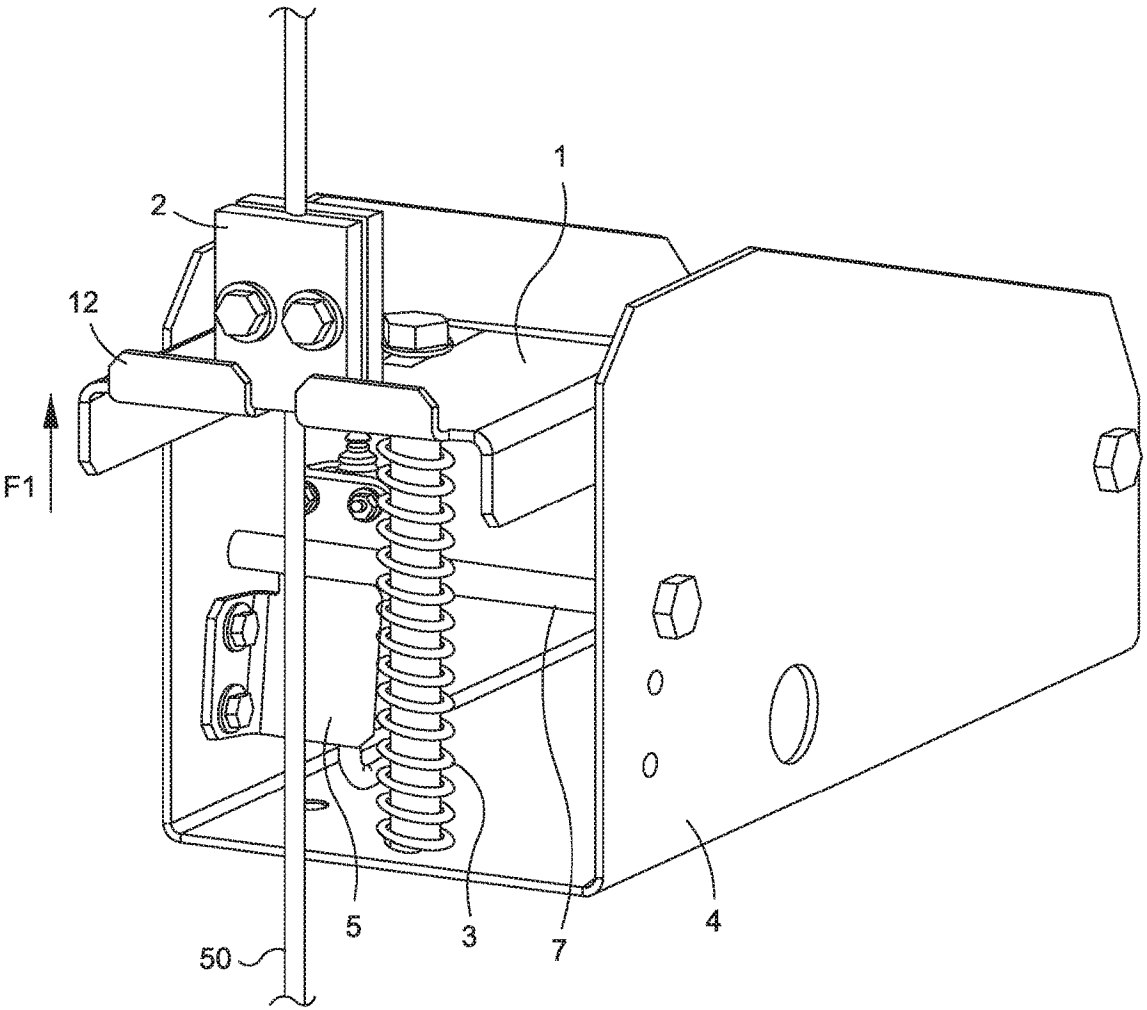
FIG. 4 shows a perspective illustration of a form of embodiment of the device for activating a safety apparatus.

In FIG. 4 the same form of embodiment is illustrated in perspective view from a different angle. The actuating element 1 is urged by the spring or the spring element 3 by the force F1 against the abutment element 2, which is attached to the speed limiter cable 50. The actuating element 1 is thus disposed in the position P1 in which the speed limiter cable 50 is raised against the force of the spring element 42 and the safety apparatus 40 is in activated position. If the actuating element 1 is now pressed downwardly by an engineer against the spring or the spring element 3 then a force no longer acts on the abutment element 2 and the speed limiter cable 50 is drawn downwardly by the force of the spring element 42 acting on the lever of the safety apparatus 40. The safety apparatus 40 is thereby deactivated.

When the engineer ends actuation of the actuating element 1 then the spring element 3 again ensures that the actuating element 1 acts once more against the abutment 2 by the force F1 and the speed limiter cable 50 is drawn upwardly again. The device comprises, for the actuating element 1, an abutment 7 which is realized in the embodiment by a bolt. This means that the engineer cannot actuate the actuating element further than up to the defined position P2. The abutment element 2 is held by the counter-bearings 12 in the position so that it cannot slip off the actuating element 1 while this is in the position P1 and thereby the safety apparatus 40 could be erroneously deactivated.

The device additionally comprises a safety switch 5 which ensures that the car cannot be moved when the actuating element 1 is in the position P1, thus in the position in which the safety apparatus is activated.

Figure 5:
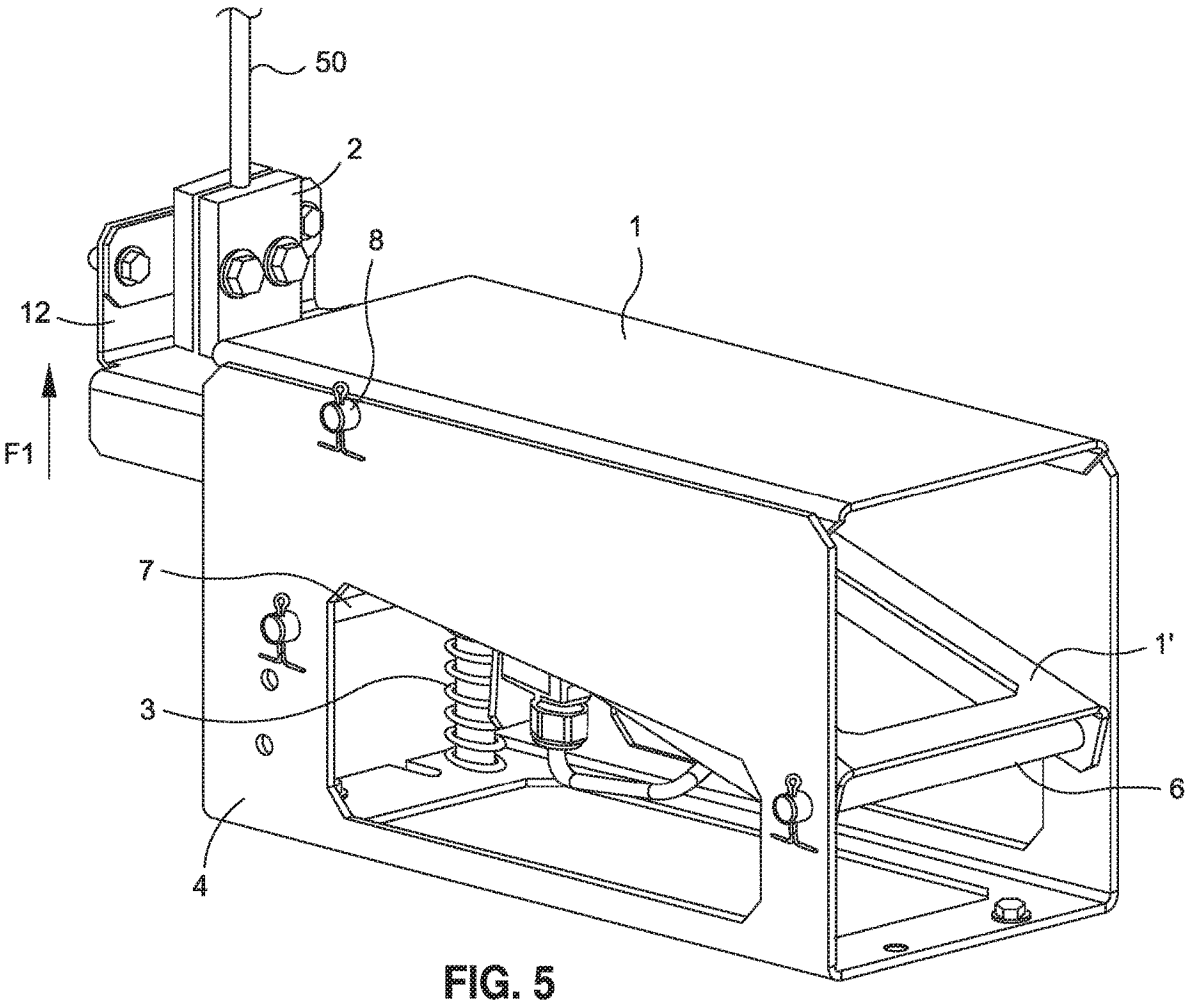
FIG. 5 shows a perspective illustration of a further form of embodiment of the device for activating a safety apparatus.

FIG. 5 shows a perspective illustration of a further form of embodiment of the device. The actuating element 1, 1' comprises, in this embodiment, a first pedal element 1, which is pressed downwardly by the engineer. This first pedal element 1 acts on a second pedal element 1', which is pressed downwardly against the spring force F1 of the spring 3 for deactivation of the safety apparatus 40. For actuation of the first pedal element 1 the engineer must thus apply the force which compensates for the action of the spring 3. The first pedal element 1 has in that case a pivot axis at the bolt 8 and the second pedal element 1' has a pivot axis at the bolt 6 and an abutment at the bolt 7. Through actuation of the pedal elements 1, 1' the vertically upwardly directed force F1 on the abutment element 2 is cancelled and thus the action on the speed limiter cable 50 is equally cancelled. The safety apparatus 40 can transfer from the activated to the deactivated state. The pedal element comprises a counter-bearing 12 for positioning of the abutment element 2 and the pedal elements 1, 1' are again accommodated in a housing 4, which minimizes risk of faulty operation by the engineer.

Figure 6:
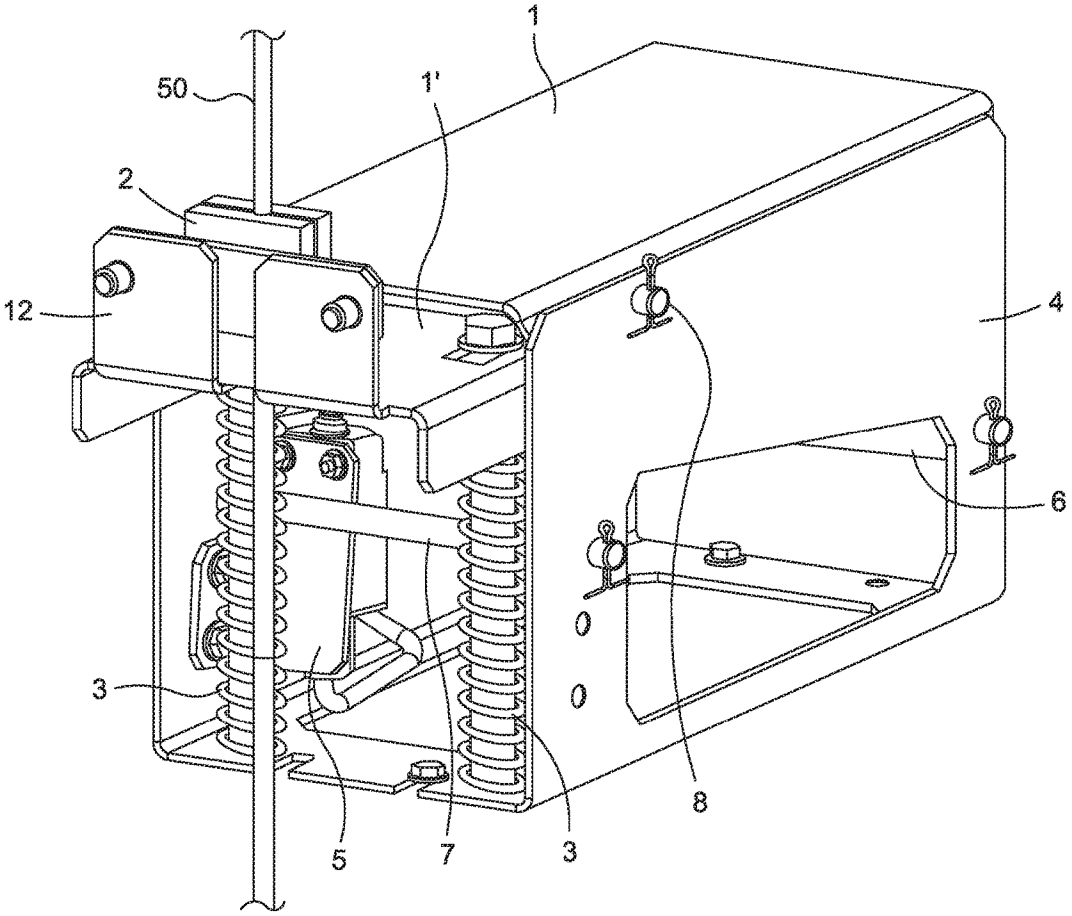
FIG. 6 shows a perspective illustration of a further form of embodiment of the device for activating a safety apparatus and FIGS. 7*a* and 7*b* show a schematic illustration of the function of a form of embodiment of the device for activating a safety apparatus.

In FIG. 6 the same form of embodiment is perspectively illustrated from a different angle. The pedal element 1' is urged by the spring or the spring element 3 by the force F1 against the abutment element 2, which is attached to the speed limiter cable 50. The pedal element 1' is thus disposed in the position P1 in which the speed limiter cable 50 is raised against the force of the spring element 42 and the safety apparatus 40 is in activated position. If the pedal element 1 is now pressed downwardly by an engineer then the pedal element 1' is similarly pressed downwardly against the spring or the spring element 3. A force no longer acts on the abutment element 2 and the speed limiter cable 50 is drawn downwardly by the force of the spring element 42 acting on the lever of the safety apparatus 40. The safety apparatus 40 is thereby deactivated. The spring or the spring element 3 is, in this embodiment, realized by two springs which are arranged on both sides at the edges of the pedal element 1'. By virtue of the two-part construction of the actuating element 1, 1' and the arrangement of the spring elements 3 on both sides a guided downward movement of the pedal element 1' is ensured so that not only the force, but also the direction of the movement of the pedal element 1' can be satisfactorily controlled.

Figure 7A:
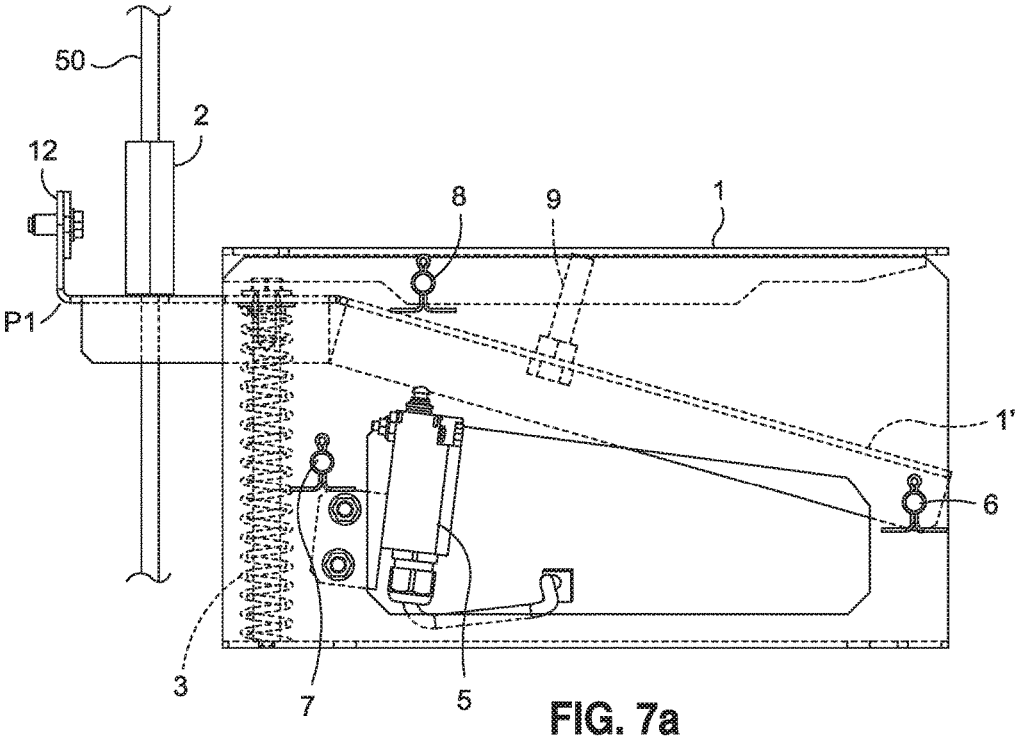
Figure 7B:
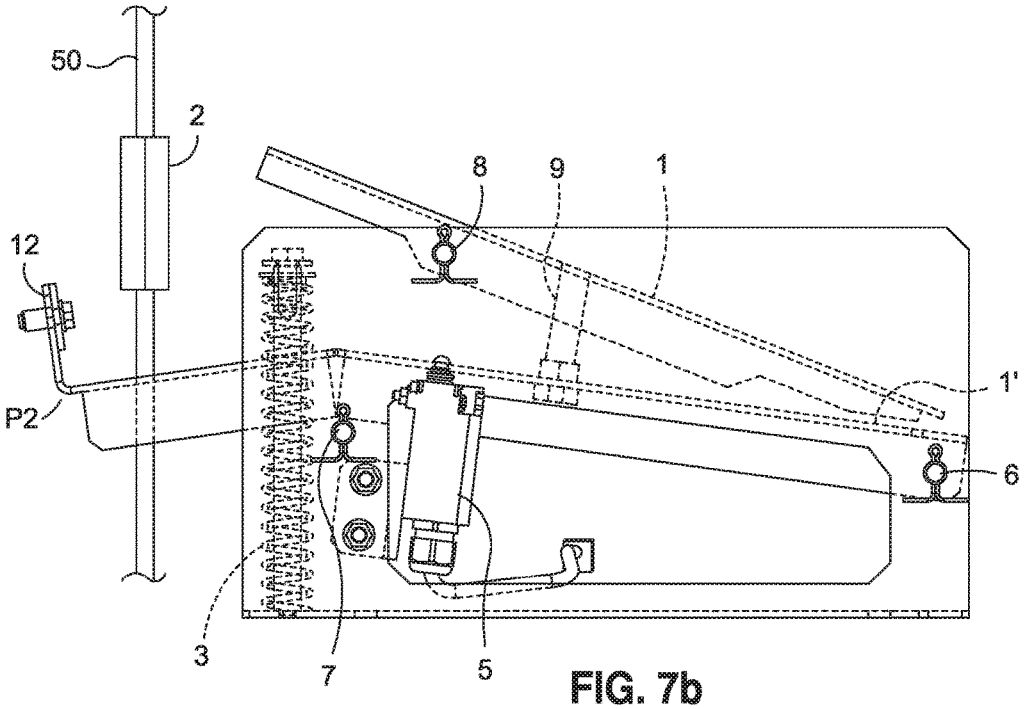

FIGS. 7*a* and 7*b* show once again a schematic illustration of the manner of operation of the pedal elements 1, 1' of the actuating element. In FIG. 7*a* the actuating element 1, 1' is in the position P1. The pedal element 1' is urged by the spring element 3 against the abutment element 2. The abutment element 2 is attached to the speed limiter cable 50, which is urged upwardly and the safety apparatus 40 is thus activated. In FIG. 7*b* the pedal element 1 of the actuating element has been actuated by the engineer. The pedal element 1 pivots about the pivot axis formed by the bolt 8. The plunger 9 is thereby moved towards the second pedal element 1' and presses this downwardly against the spring force of the spring element 3. In the alternative, the plunger can also be arranged at the second pedal element 1' so that the first pedal element 1, when actuated, acts on the plunger. The actuating element 1, 1' is thus in position P2. The pivot axis of the second pedal element 1' is in that case formed by the bolt 6. The device has an abutment 7 so that the second pedal element 1' can be pressed downwardly only as far as a defined point. By virtue of the downward movement of the second pedal element 1' the abutment element 2 is free and the upwardly directed force F1 on the speed limiter cable 50 is cancelled. The safety apparatus is thereby deactivated. The second pedal element 1' contacts the safety switch 5 and the car 30 can move.

The examples in the figures show possible forms of embodiment of the invention. It will be obvious that realization of the device according to the invention can also be effected in different mode and manner.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A device for activating and deactivating a safety apparatus of an elevator car during assembly of an elevator installation, the device comprising:

an actuating element adapted to be attached to the elevator car, wherein the actuating element in a first position acts on the safety apparatus of the elevator car to activate the safety apparatus and prevent movement of the elevator car, wherein the actuating element when actuated into a second position does not act on the safety apparatus, and wherein the actuating element includes a pedal manually movable into the second position against a restoring force;

a housing in which the pedal is received wherein an activation area of the actuating element is limited by projections or edges of the housing that protrude beyond the pedal; and, wherein the device is removably mounted on a roof of the elevator car.

2. The device according to claim 1 wherein the actuating element in the first position acts on a speed limiter cable connected to the safety apparatus to activate the safety apparatus.

3. The device according to claim 2 wherein the actuating element has a cut-out within which the speed limiter cable is guided.

4. The device according to claim 2 wherein the actuating element is configured to exert a force on the speed limiter cable when the actuating element moves towards the first position and the actuating element is configured to cancel the force on the speed limiter cable when the actuating element moves towards the second position.

5. The device according to claim 2 including an abutment element for releasably fixing to the speed limiter cable, wherein the actuating element in the first position exerts a vertically upwardly directed force on the abutment element.

6. The device according to claim 5 wherein the actuating element has counter-bearings for positioning the abutment element relative to the actuating element.

7. The device according to claim 5 wherein a spring element is arranged between the abutment element and the actuating element.

8. The device according to claim 1 wherein the restoring force is generated by a spring element.

9. The device according to claim 1 including a safety switch for preventing movement of the elevator car when the safety apparatus is activated.

10. A method of using the device according to claim 1 for preventing unintended movement of the elevator car during assembly of the elevator installation, comprising the steps of:

removably mounting the device on the elevator car;

disposing the actuating element in the first position; and bringing the actuating element into the second position before the elevator car is moved.

11. A device for activating and deactivating a safety apparatus of an elevator car during assembly of an elevator installation, the device comprising:

an actuating element adapted to be attached to the elevator car, wherein the actuating element in a first position acts on the safety apparatus of the elevator car to activate the safety apparatus and prevent movement of the elevator car, wherein the actuating element when actuated into a second position does not act on the safety apparatus, and wherein the actuating element includes a pedal manually movable into the second position against a restoring force; and a housing in which the actuating element is received wherein an activation area of the actuating element is limited by projections or edges of the housing that protrude beyond the actuating element and wherein the actuating element removably is mounted on a roof of the elevator car.

12. A method of using a device for preventing unintended movement of an elevator car during assembly of an elevator installation, comprising the steps of:

providing the device having an actuating element adapted to be attached to the elevator car, wherein the actuating element in a first position acts on the safety apparatus of the elevator car to activate the safety apparatus and prevent movement of the elevator car, wherein the actuating element when actuated into a second position does not act on the safety apparatus, and wherein the actuating element includes a pedal manually movable by the engineer into the second position against a restoring force, and the device having a housing in which the actuating element is received wherein an activation area of the actuating element is limited by projections or edges of the housing that protrude beyond the actuating element;

removably mounting the device on the elevator car;

disposing the actuating element in the first position; and bringing the actuating element into the second position before the elevator car is moved wherein removably mounting the device on the elevator car includes removably mounting the device on a roof of the elevator car.

* * * * *